US005277578A

United States Patent [19]

Ratnani et al.

[11] Patent Number: 5,277,578

[45] Date of Patent: Jan. 11, 1994

[54] GAS BURNER HAVING TANGENTIAL COUNTER-ROTATION AIR INJECTORS AND AXIAL GAS INJECTOR TUBE

[75] Inventors: Kebir Ratnani, Boucherville; Normand Brais, Rosemère, both of Canada

[73] Assignee: Gaz Metropolitain & Co., Ltd. and Ptnr., Montreal, Canada

[21] Appl. No.: 986,768

[22] Filed: Dec. 8, 1992

[51] Int. Cl.[5] ..... F23D 14/22

[52] U.S. Cl. ..... 431/351; 431/9; 431/173; 431/352

[58] Field of Search ..... 431/8, 9, 10, 173, 170, 431/352, 351, 353; 60/732, 733; 110/264

[56] References Cited

U.S. PATENT DOCUMENTS

| | | | |
|---|---|---|---|
| 3,376,098 | 4/1968 | Pryor | 431/10 |
| 3,729,285 | 4/1973 | Schwedersky | 431/8 |
| 3,993,449 | 11/1976 | Childs | 431/8 |
| 4,708,637 | 11/1987 | Dutescu | 431/352 |
| 4,902,222 | 2/1990 | Belle | 431/353 |
| 5,000,679 | 3/1991 | Fukuda et al. | 431/173 |
| 5,002,483 | 3/1991 | Becker | 431/352 |

*Primary Examiner*—James C. Yeung
*Attorney, Agent, or Firm*—Longacre & White

[57] ABSTRACT

A gas burner is described having a cylindrical combustion chamber having at least two spaced apart counter-rotation stationary tangential air injectors and at least three sets of radial injection holes in between for admitting air under pressure in the combustion chamber to cause adjacent counter-rotation air turbulence regions in said combustion chamber. The combustion chamber has a closed end and an open end with a gas injector tube extending in the chamber from the closed end and disposed centrally therein. The injector tube has combustion gas injection ports at least upstream and downstream of the at least two air injectors to create a combustion mixture which is initially fuel-lean to generate a flame having a lower temperature and producing less nitrogen oxide than with conventional gas burners of this type. An air chamber is provided about at least a portion of the combustion chamber and communicates with the tangential air injectors.

12 Claims, 2 Drawing Sheets

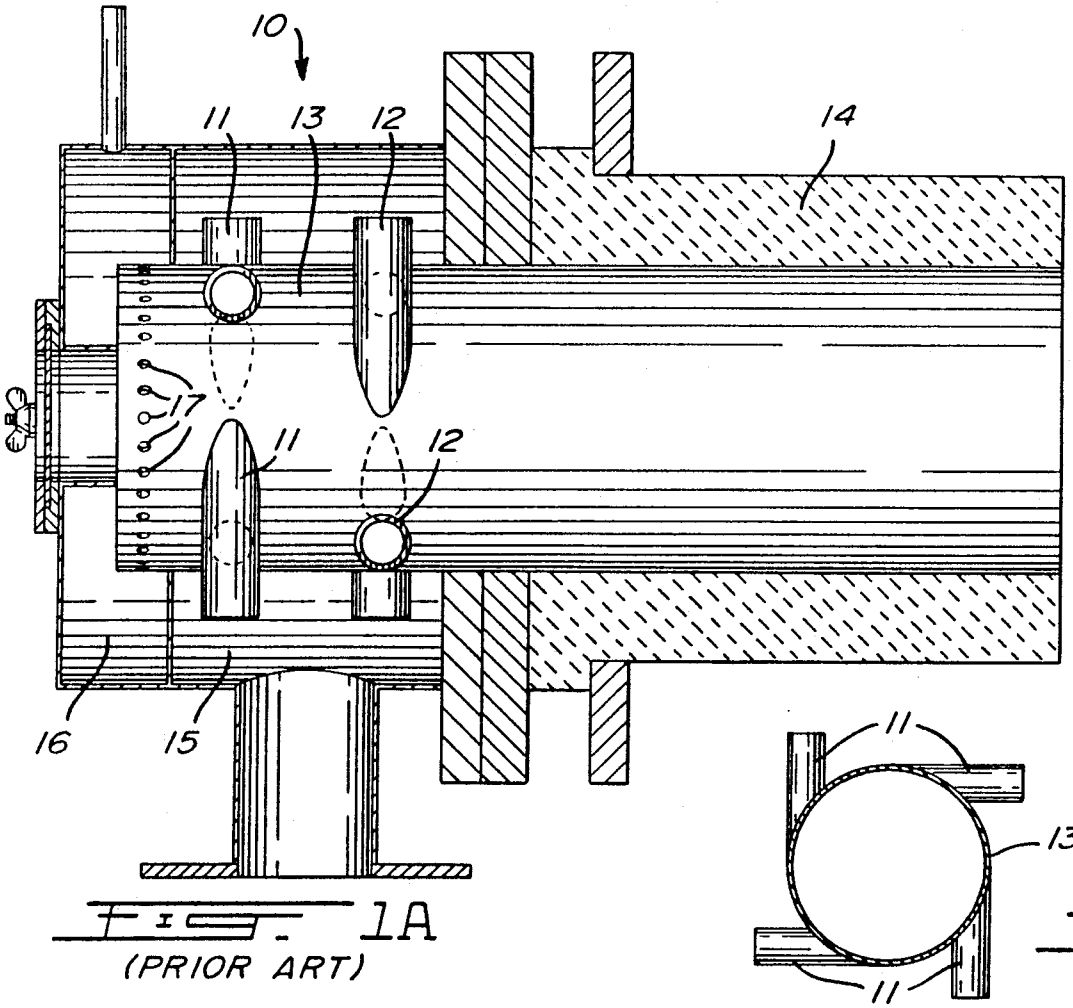
FIG. 1A (PRIOR ART)
FIG. 1B (PRIOR ART)
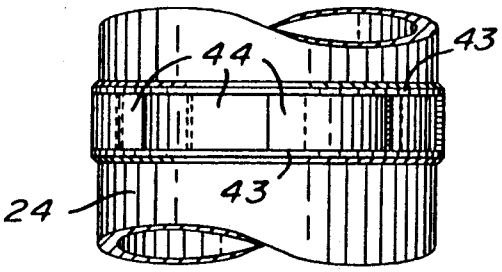
FIG. 3A
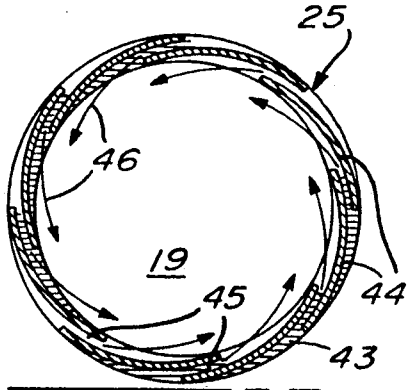
FIG. 3B

GAS BURNER HAVING TANGENTIAL COUNTER-ROTATION AIR INJECTORS AND AXIAL GAS INJECTOR TUBE

TECHNICAL FIELD

The present invention relates to a gas burner of the type having tangential counter-rotation air injectors about a portion of a cylindrical combustion chamber, the improvement residing in providing a gas injector tube axially disposed within the combustion chamber and having gas injections ports located both upstream and downstream of the air injectors to reduce flame temperature peaks thereby reducing the formation of nitrogen oxides.

BACKGROUND ART

It is known to provide a burner with two tangential counter-rotation air injectors disposed in a portion of a cylindrical burner chamber to produce air turbulence therein to obtain a rapid mixture of air and gas, more particularly natural gas. In such burners the gas is injected upstream of the tangential air ports by a ring of gas ports formed about the cylindrical burner housing. Such burners operate at low pressure and provide the advantage in that it produces a flame which is very intense due to the fact that the mixture of gas and air is very homogeneous because of the turbulence caused by the counter-rotation air injectors. With such burners it is possible to obtain volumeric heat release of the order of 100 $MW/m^3$ for the combustion chamber and to provide a burner which is very compact and inexpensive per unit of power produced.

Burners having counter-rotation air injectors have been used in various industrial applications, such as for the heating liquids, be it for submerged heating tubes or for incineration. However, such burners have disadvantages and an important one is that it produces too much nitrogen oxides in the range of 200 to 400 ppm corrected at 3% $O_2$. It therefore limits the application of the burner, particularly in North America where pollution emission standards are very stringent.

SUMMARY OF INVENTION

It is therefore a feature of the present invention to provide an improved gas burner having counter-rotation air injection ports provided in a portion of a cylindrical burner housing and wherein the combustion gas is injected both upstream and downstream of the tangential injectors.

Another feature of the present invention is to provide a gas burner capable of producing a multi-stage flame of lower maximum temperature than the prior art described above and with a substantial reduction in nitrogen oxide production.

According to the above features, from a broad aspect, the present invention provides a gas burner comprising a cylindrical combustion chamber having at least two spaced apart counter-rotation stationary tangential air injectors and radial injectors for admitting air under pressure in the combustion chamber to cause adjacent counter-rotation air turbulence regions in the combustion chamber. The combustion chamber has a closed end and an open end. A gas injector tube extends in the combustion chamber from the closed end and is disposed centrally therein. The injector tube has combustion gas injection ports at least upstream and downstream of the air injectors to create a combustion mixture which is fuel-lean to generate a flame having a lower temperature and which produces less nitrogen oxide. An air chamber is disposed in at least a portion of the combustion chamber and communicates with the tangential air injectors. Means is provided to introduce air under pressure in the air chamber. An igniting device is provided in the combustion chamber to ignite the mixture of air and gas to produce the flame.

BRIEF DESCRIPTION OF DRAWINGS

A preferred embodiment of the present invention will now be described with reference to the accompanying drawings in which:

FIG. 1A is a side view, partly sectioned, illustrating a burner of the prior art having counter-rotation air injectors;

FIG. 1B is a simplified cross-section view showing the orientation of the counter-rotation air injectors about the cylindrical burner housing;

FIG. 3A is a side view illustrating the construction of one of the tangential injectors; and FIG. 3B is a section view across a tangential injector.

DESCRIPTION OF PREFERRED EMBODIMENTS

Figure 2:
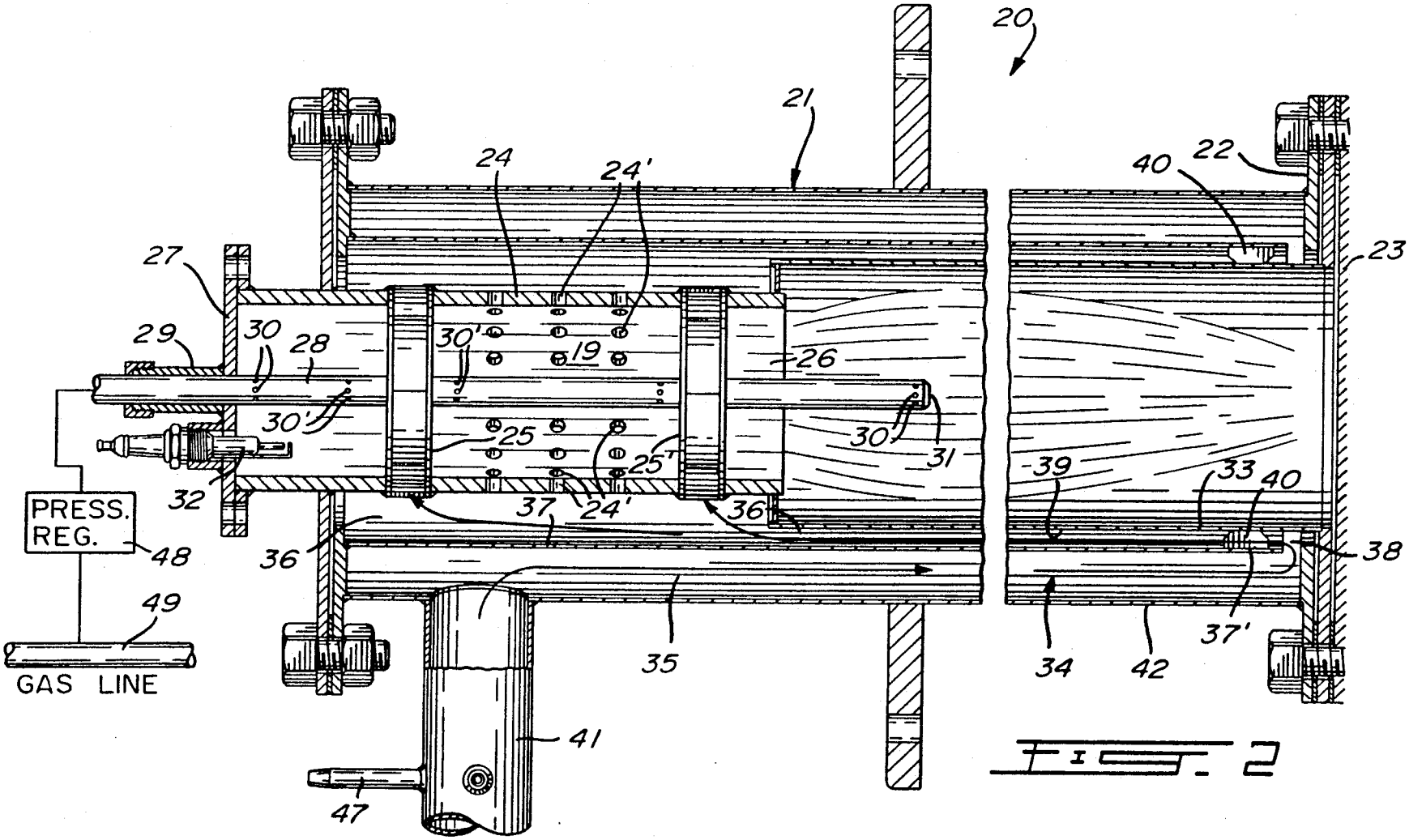
FIG. 2 is a sectional side view, partly fragmented, showing the construction of the gas burner of the present invention provided with two counter-rotation air injectors.

Referring to the drawings and more particularly to Figures 1A and 1B, there is shown the construction of a prior art gas burner 10 having tangential air injectors 11 and 12 positioned one adjacent the other to direct air in counter-rotation with one another. There may be two or more of these injectors 11 and 12 provided about the cylindrical wall of the burner chamber 13. A refractory material 14 lines the portion of the cylindrical chamber 13 where the flame is produced and where there is more heat intensity. Air under pressure is fed into a plenum chamber 15 by the counter-rotation injectors 11 and 12. Between the tangential air injectors, three or more sets of radial injection holes 24'are provided in order to homogenize the air distribution along the axis.

Upstream of the tangential injectors is a gas chamber 16 to which gas, herein natural gas, under pressure is fed. This gas is injected within the burner plenum chamber 15 upstream of the tangential injectors through a plurality of pin holes 17 distributed circumferentially about the cylindrical burner housing 13. As previously described, such a burner with counter-rotation tangential injectors produces a gas/air mixture which is very homogeneous resulting in a very intense flame. However, a disadvantage is that the burner produces excessive nitrogen oxides, and the combustion chamber must be lined with refractory material.

Referring now to FIG. 2, there is shown generally at 20 the improved gas burner of the present invention. The gas burner has a housing 21 having an attachment flange 22 at one end thereof for securing same to a furnace wall 23, or heating tubes, or any other suitable device. A cylindrical combustion chamber is herein formed by a steel cylindrical plenum chamber 24 having two spaced apart counter-rotation stationary tangential air injectors 25 secured thereto to admit combustion air under pressure within the cylindrical housing 24. The construction of these tangential air injectors is illustrated in FIGS. 3A and 3B, as will be described later.

The cylindrical plenum chamber 24 has an open end 26 leading to the combustion chamber 33 and an outer end wall 27. A gas injector tube 28 extends axially within the steel cylindrical plenum chamber 24 at the center thereof and protrudes through a sealed sleeve coupling 29 formed within the end wall 27. The gas injector tube 28 is provided with groups of gas injection ports 30 which are of pin hole size and disposed upstream of a first tangential air injector 25 and downstream of a second air injector 25' and adjacent the free end 31 of the tube 28. Additional gas injection ports may be provided along the injection tube, such as illustrated at 30', and preferably closer to the air injectors 25 and 25'. A spark plug 32 is also disposed within the end wall 27 and provides for the ignition of the combustible mixture of gas and air within the cylindrical plenum chamber 24.

By introducing the gas both upstream and downstream of the injector ports, it can be seen that a multistage flame can be produced. A first flame section is produced from the upstream side of the tangential air injector 25 and between the injectors where it is fuel-lean due to the high ratio of air to fuel in that area, as only a portion of the fuel is injected on the upstream side. Because there is excess air in the cylindrical plenum chamber 24, the steel cylinder can withstand the temperatures of that flame as it is cooled by the excessive air flowing tangentially thereagainst inside the chamber. As the inner flame section reaches the open end 26 of the cylindrical plenum chamber 24, it again mixes with the gas released adjacent the end of the injector tube 28 and produces a flame which extends into the combustion chamber 33 of the burner. The chamber 33 need not be constructed of a refractory material due to the reduced temperature of the flame, and therefore can be made of stainless steel or any suitable steel alloy. It is furthermore noted that the chamber 33, as well as the cylindrical plenum chamber 24 are both in contact with cooling air under pressure contained within the air chamber 34 thereabout through which air is disposed to feed the tangential injectors 25 and 25'.

The air chamber 34 is a cylindrical air chamber disposed about at least a portion of the cylindrical plenum chamber 24 and the combustion chamber 33 of the gas burner. The air chamber 34 defines an outer and an inner enclosed cylindrical chamber 35 and 36, respectively, which are divided by an intermediate cylindrical wall 37. The inner and outer chambers 36 and 35, respectively, communicate with one another through the end passage 38 at a free end 37'of the intermediate cylindrical wall which is spaced from the outer surface 39 of the combustion chamber 33 of the burner housing by a spacer element 40. At an opposed end of the outer chamber 35 an air supply conduit 41 is provided and communicates with the outer chamber 35. Air is supplied under pressure in the conduit 41 and flows substantially along the entire length of the outer chamber 35 and in the process cooling the outer wall 42 of the housing 21 and the intermediate wall 37. The air then enters into the inner chamber 36 cooling the second cylindrical combustion chamber 33 and the steel cylindrical plenum chamber 24. The air then enters into the cylindrcial plenum chamber 24 through the tangential air injectors 25 and 25'which are oriented in counter-rotation.

As shown in FIGS. 3A and 3B, the tangential air injectors 25 and 25'are comprised of a pair of annular spaced side walls 43 and a plurality of transverse curved veins 44 secured between the side walls and spaced apart to define like arcuate tangential channels 45 therebetween to direct air under pressure from the inner chamber 36 into the inner space 19 of the plenum chamber 24. As shown in FIG. 3B the air under pressure will follow a spiral path, as illustrated by arrow 46, and rotate within the space 19 in a clockwise and a counter-clockwise direction, as shown in FIG. 3B. As herein shown, the tangential air injector 25 is oriented with its veins generating a clockwise air turbulence within the space 19 while the other injector 5' is orineted to provide a counter-clock rotation of the air.

The air within the conduit 41 is supplied at a predetermined pressure which is preferably adjustable. A nipple connection 47 is secured to the air conduit 41 to supply auxiliary cooling air for the burner. The gas within the hollow gas injector tube 28 is also connected to a pressure regulating device 48 which is connected to a gas supply line 49 to regulate the pressure of the gas injected within the burner so that the flame intensity and quality may be controlled. The injector tube 28 may be constructed from an alloy of stainless steel. The injector tube 28 extends beyond the end of the plenum chamber 24 to produce the main flame in the combustion chamber 33.

The preferred embodiment above described of this burner is capable of producing a combustion flame with an approximate reduction of 50% of the nitrogen oxide, that is to say, less than 100 to 200 ppm, as compared with known burners having tangential counter-rotaton injectors. Also, the construction of the burner is much simplified and more economical than known prior art burners, as the burner can be constructed of stainless steel due to the reduction in flame temperature and improved cooling of the combustion chamber. Other obvious modifications of the preferred embodiment described herein may become obvious to a person skilled in the art, and it is intended to be covered, provided such fall within the scope of the appended claims.

We claim:

1. A gas burner comprising a cylindrical combustion chamber having at least two, spaced apart, counter-rotation stationary tangential air injectors, and a plurality of radial injection holes therebetween, for admitting air under pressure in said combustion chamber to cause adjacent counter-rotation air turbulence regions in said combustion chamber, said combustion chamber having a closed end and an open end, a gas injector tube extending in said combustion chamber from said closed end and disposed centrally therein, said injector tube having combustion gas injection ports at least upstream and downstream of said at least two air injectors to create a combustion mixture which is initially fuel-lean to generate a flame having a lower temperature and producing less nitrogen oxide, an air chamber about at least a portion of said combustion chamber and communicating with said tangential air injectors, means to introduce air under pressure in said air chamber, and an igniting device in said combustion chamber.

2. A gas burner as claimed in claim 1 wherein said injector tube is provided with injection ports distributed at different locations to produce a multi-stage distribution of said combustion gas at predetermined locations with respect to said tangential air injectors, and pressure regulating means to control the pressure of said combustion gas in said gas injector tube.

3. A gas burner as claimed in claim 2 wherein said tangential air injectors are ring-shaped stationary injectors comprised by a pair of annular spaced side walls, and a plurality of transverse curved vanes secured between said side walls and spaced apart to define like arcuate tangential channels therebetween to direct air under pressure from said air chamber into said combustion chamber in a clockwise or counter-clockwise direction dependent on the orientation of said injectors, said adjacent injectors being oriented with said tangential channels in counter directions.

4. A gas burner as claimed in claim 3 wherein said air chamber is a cylindrical air chamber disposed about at least said portion of said combustion chamber, said air chamber having an outer and an inner cylindrical chamber divided by an intermediate cylindrical wall, said inner and outer chambers communicating with one another in a first end portion of said air chamber, an air injector secured to an outer wall of said outer chamber at a second opposed end portion of said air chamber whereby said air under pressure will flow substantially along the entire length of said outer chamber and a substantial portion of said inner chamber to provide a cooling jacket for said combustion chamber.

5. A gas burner as claimed in claim 4 wherein said gas injector tube is a hollow tube constructed from an alloy of stainless steel.

6. A gas burner as claimed in claim 2 wherein said injection ports are disposed in groups and further located intermediate said tangential air injectors in close proximity to each of said air injectors.

7. A gas burner as claimed in claim 2 wherein said pressure regulating means is a pressure regulator connected between a gas distribution line and said gas injector tube.

8. A gas burner as claimed in claim 7 wherein said gas distribution line is a natural gas line.

9. A gas burner as claimed in claim 1 wherein said flame contains less than 100 to 200 ppm of nitrogen oxide.

10. A gas burner as claimed in claim 1 wherein said burner housing is constructed of steel and preferably stainless steel due to said reduction in the temperature of the burner flame resulting from the distribution of the gas injected at different locations within the combustion chamber and said air chamber about said combustion chamber.

11. A gas burner as claimed in claim 1 wherein said combustion chamber is comprised of a cylindrical plenum chamber to which said injectors are connected, said plenum chamber having an open end leading to an axially aligned cylindrical combustion chamber, said injector tube terminating at a free end beyond said open end of said plenum chamber and into said combustion chamber, said injector tube having gas ports at said free end thereof and producing within said plenum and combustion chamber a multi-stage flame.

12. A gas burner as claimed in claim 1 wherein said plurality of radial air injection holes are comprised by at least three sets of a plurality of radial injection holes disposed about said combustion chamber and spaced apart between said two tangential air injectors to homogenize air distribution in said combustion chamber.

* * * * *